US009741294B2

(12) United States Patent
Abe

(10) Patent No.: US 9,741,294 B2
(45) Date of Patent: Aug. 22, 2017

(54) DISPLAY DEVICE AND DISPLAY CHARACTERISTIC CORRECTION METHOD

(75) Inventor: Masatoshi Abe, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 108 days.

(21) Appl. No.: 14/390,955

(22) PCT Filed: Apr. 10, 2012

(86) PCT No.: PCT/JP2012/059802
§ 371 (c)(1),
(2), (4) Date: Oct. 6, 2014

(87) PCT Pub. No.: WO2013/153622
PCT Pub. Date: Oct. 17, 2013

(65) Prior Publication Data

US 2015/0054806 A1 Feb. 26, 2015

(51) Int. Cl.
*G09G 3/36* (2006.01)
*G09G 5/18* (2006.01)
(Continued)

(52) U.S. Cl.
CPC ..... *G09G 3/36* (2013.01); *G09G 3/006* (2013.01); *G09G 5/10* (2013.01); *G09G 5/18* (2013.01);
(Continued)

(58) Field of Classification Search
None
See application file for complete search history.

(56) References Cited

U.S. PATENT DOCUMENTS 5,774,639 A * 6/1998 Schildkraut ..... B41M 5/38207 358/1.16
2008/0246781 A1* 10/2008 Surati ..... H04N 5/74 345/690
(Continued)

FOREIGN PATENT DOCUMENTS

CN 1881400 A 12/2006
CN 101029985 A 9/2007
(Continued)

OTHER PUBLICATIONS

Japanese Office Action dated Jul. 7, 2015 in co-pending Japanese Application No. 2014-509937 with a partial English translation thereof.
(Continued)

*Primary Examiner* — Antonio Xavier
(74) *Attorney, Agent, or Firm* — McGinn IP Law Group, PLLC.

(57) ABSTRACT

A display device includes: a display panel that displays an image; an optical sensor which measures an irradiation amount of light emitted by a display panel as a measured optical value; a measured value revising unit which revises a revision target measured optical value using a function and outputs it as a revised measured optical value; and a signal processing unit which generates from the revised measured optical value, a control value and generates a post-processing video signal from the control value and an input video signal supplied from an external device. The function represents a change in the irradiation amount during a disabled period in which the signal processing unit disables a stabilizing function of keeping the irradiation amount of the light source of the display panel constant.

7 Claims, 5 Drawing Sheets

(51) Int. Cl.
*G09G 3/00* (2006.01)
*G09G 5/10* (2006.01)

(52) U.S. Cl.
CPC ..... *G09G 2320/0233* (2013.01); *G09G 2320/043* (2013.01); *G09G 2320/0626* (2013.01); *G09G 2320/0693* (2013.01); *G09G 2360/14* (2013.01); *G09G 2360/145* (2013.01)

(56) References Cited

U.S. PATENT DOCUMENTS

2009/0015728 A1* 1/2009 Abe ..... G09G 5/00 348/739
2009/0033612 A1* 2/2009 Roberts ..... G09G 3/3413 345/102
2011/0128263 A1* 6/2011 Abe ..... G09G 3/3406 345/207
2011/0227964 A1* 9/2011 Chaji ..... G09G 3/006 345/690
2011/0285763 A1* 11/2011 Bassi ..... G06T 5/008 345/694
2012/0032969 A1* 2/2012 Sugiyama ..... G06F 3/1431 345/589
2012/0050505 A1* 3/2012 Yabui ..... G02B 27/2235 348/54
2012/0154352 A1* 6/2012 Yamashita ..... G09G 3/3233 345/207

FOREIGN PATENT DOCUMENTS

| | | | |
|---|---|---|---|
| CN | 101044548 | A | 9/2007 |
| CN | 101055735 | A | 10/2007 |
| CN | 100422823 | C | 10/2008 |
| CN | 101382453 | A | 3/2009 |
| JP | 08-179276 | A | 7/1996 |
| JP | 2006-276725 | A | 10/2006 |
| JP | 2008-102490 | A | 5/2008 |
| JP | 2009-053842 | A | 3/2009 |
| JP | 2009-058342 | A | 3/2009 |
| TW | 200644729 | A | 12/2006 |
| WO | WO 2007/023681 | A1 | 3/2007 |
| WO | WO 2011/121880 | A1 | 10/2011 |

OTHER PUBLICATIONS

International Search Report (ISR) (PCT Form PCT/ISA/210), in PCT/JP2012/059802, dated Jul. 17, 2012.
Chinese Office Action in corresponding application No. CN 201280072228.0 dated Feb. 3, 2016 and English Translation thereof.

* cited by examiner

Prior Art

Prior Art

DISPLAY DEVICE AND DISPLAY CHARACTERISTIC CORRECTION METHOD

TECHNICAL FIELD

The present invention relates to a display device (such as a liquid crystal monitor or a projector), and a display characteristic correction method.

BACKGROUND ART

In recent years, liquid crystal display devices that display an image on a display panel using a backlight are being widely used in a variety of industrial fields. For example, FPDs (Flat Panel Display) that display a video signal supplied from the exterior of the liquid crystal display device on a display panel using liquid crystals are being frequently used. Such liquid crystal display devices include a display panel using a liquid crystal element and an optical member of a backlight (light source, BL: Back Light) such as an extra-high pressure mercury lamp, a W/RGB LED (Light Emitting Diode), or a cold-cathode tube (CCFL: Cold Cathode Fluorescent Lamp), that irradiates light to the display panel. Furthermore, the display device includes, as a circuit part, a BL driving part that controls the brightness of the light emitted by the backlight, and a circuit that drives the display panel.

In a case where the display device mentioned above is used as a display device in graphic design or for medical applications, it is required that the display characteristics (stability of the color display) specified beforehand be maintained over a long period, and for it to represent a display quality that can be utilized in a state where it is constantly stable.

There exists a display device that, when this stable state is to be maintained, is provided with an optical sensor, such as a brightness sensor or a color sensor, on the display surface of the display panel, that stabilizes the display quality and measures the brightness or the color, and performs adjustments corresponding to the display characteristics according to the measured values (for example, refer to Patent Document 1). In a case where the optical sensor is provided on the display surface of the display panel, it becomes possible to measure not only the brightness value, but also to measure the displayed color and the gamma ($\gamma$) characteristics of the display panel in order to maintain the display quality.

On the other hand, there also exists a display device that is provided with an optical sensor or the like, not on the display surface but on the back surface of the display panel, that stabilizes the display quality by means of the measured values. For example, in a case where the display device is a liquid crystal display device, if an optical sensor is provided on the back surface of the liquid crystal panel (display panel), the brightness of the light irradiated is stabilized by measuring the brightness of the light irradiated by the backlight to the liquid crystal panel.

Therefore, a configuration that provides the optical sensor on the display surface of the display panel has an advantage compared to a configuration that provides the optical sensor on the back surface of the display panel, from the point that it is able to better perform the stabilization of the display quality.

Next, FIG. 6 is a diagram showing a configuration example of a liquid crystal display device 200 of the configuration mentioned above that provides the optical sensor on the back surface of the display panel.

An optical sensor 205 measures the brightness of the light irradiated by the backlight 3 to the back surface of a display panel 2, and outputs the measurement result as a measured optical value to a signal processing unit 204.

The signal processing unit 204, by means of the measured optical value supplied from the optical sensor 205, converts the gradient of an input video signal that is input from an external device into a post-processing video signal that drives the display element of the display panel 2, and outputs it to the display panel 2. Furthermore, the signal processing unit 204 generates a drive signal such that the brightness value of the light emitted by the backlight 3 becomes a set brightness value that is preset in an internal storage part, that is to say, the brightness value of the light irradiated becomes constant even if the temperature changes, and performs control of the backlight 3 by means of the drive signal.

Next, FIG. 7 is a diagram showing a configuration example of a liquid crystal display device 300 of the configuration mentioned above that provides the optical sensor on the display surface of the display panel.

In a case where an optical sensor 5, for example, represents a brightness sensor, it measures the brightness of the light transmitted through, and emitted from, a measurement area 21 of a display panel 2, and emitted by a backlight 3 to the display panel 2, and outputs the measurement result as a measured optical value to a signal processing unit 304.

The signal processing unit 304, by means of the measured optical value supplied from the optical sensor 5, converts the gradient of an input video signal that is input from an external device into a post-processing video signal that drives the display element of the display panel 2, and outputs it to the display panel 2. Furthermore, the signal processing unit 304 generates a drive signal such that the brightness value of the light emitted by the backlight 3 transmitted through the measurement area 21 becomes a set brightness value that is preset in an internal storage part, that is to say, the brightness value of the light irradiated becomes constant even if the temperature changes, and performs control of the backlight 3 by means of the drive signal.

At this time, the signal processing unit 304 measures a black brightness level and a white brightness level, and calculates a drive signal with respect to the backlight 3 and a post-processing video signal such that the dynamic range becomes a preset numerical value. That is to say, by controlling the degree of opening of the display element in the measurement area 21, the brightness value transmitted from the measurement area 21 corresponding to the degree of opening can be measured. Furthermore, as mentioned above, it is possible to measure not only the white brightness level, but also the black brightness level or the brightness values of a plurality of halftones (gradients between the white brightness level and the black brightness level) for determining the gamma characteristics.

In the liquid crystal display device of FIG. 7 mentioned above, in a case other than a measurement that makes constant the brightness value of the light emitted from the display panel 2 and stabilizes the display quality, for example when a color measurement, a gamma characteristics measurement, or a measurement of the black brightness level or of a halftone is performed, it is necessary for the signal processing unit 204 to disable the brightness stabilization function. The brightness stabilization function generally measures the white brightness level by making white be displayed at the measurement area 21, and controlling the brightness value of the light irradiated by the backlight 3 such that the brightness value becomes constant. That is to say, the brightness stabilization function controls the drive signal that drives the backlight 3 such that the brightness value of the white brightness level becomes a preset set value.

Consequently, in a case where a measurement other than that of the white brightness level is performed, if the brightness value is not measured in a state where the brightness stabilization function is disabled, for example if a measurement of the brightness value of the black brightness level is performed, the signal processing unit 304 reads the brightness value of the black brightness level as the brightness value of the white brightness level. Then the signal processing unit 304 controls the backlight 3 and the display panel 2 according to the brightness value of the black brightness level such that it becomes a preset set value, that is to say, the brightness value of the white brightness level. Therefore, the brightness value of the light transmitted from the display panel 2 is not correctly controlled.

Consequently, in a case where a measurement of a brightness value other than that of the white brightness level is performed, the measurement process is performed with the brightness stabilization function mentioned above disabled.

However, in a case where the brightness stabilization function is disabled, color measurements, gamma characteristic measurements, and measurements of the black brightness level or of the brightness values of halftones are performed without performing control of the brightness value of the light irradiated by the backlight 3. Then, after the signal processing unit 304 completes the processing for stabilizing the display quality, that is to say, after the signal processing unit 304 has completed the color measurement, the gamma characteristic measurement, or the measurement of the black brightness level or of the brightness value of a halftone, it makes active the brightness stabilization function, and changes from a measurement mode for performing optical measurements of the display quality to a normal mode for performing a normal image display.

At this time, if the brightness stabilization function is disabled, there is a concern of the brightness value of the light transmitted through the display panel 2 changing. For example, in a case where a CCFL is used for the backlight 3, since the luminous efficiency of the CCFL changes with the temperature, if the illumination time is long the temperature rises and hence the brightness value of the light irradiated to the display panel 2 changes.

Next, FIG. 8 is a diagram explaining the brightness value of the light irradiated by the backlight 3. In FIG. 8, for example in a case where the brightness value of the light irradiated by the backlight 3 is stable even after time has elapsed, the brightness value L0 measured at the time T0 and the brightness value L1' measured at the time T1 become equal. However, in a case where the brightness value of the light irradiated by the backlight 3 changes with the elapsing of time, the brightness value L0 measured at the time T0 and the brightness value L1 measured at the time T1 are not equal.

Therefore, when the brightness stabilization function is disabled and the gamma characteristics or brightness values, such as of a halftone or the black brightness level, are being measured, a displacement in the brightness value occurs depending on the time at which the measurement is performed as a result of changes in the brightness value of the light irradiated by the backlight 3 to the display panel 2. That is to say, at the time of a measurement of the measured optical value for performing stabilization of the display quality, if a video signal to be made the same gradient is provided to the display panel 2 and the measurement is performed at a different time, although the control value of the gradient is the same, different brightness values are measured as the measured optical values each time. Consequently, the measured optical value that is measured for adjusting the set value that controls the display quality in a state where the brightness stabilization function is active becomes measured each time as a value that is displaced with respect to a state where the brightness stabilization function is active. As a result, by using each of the measured optical values measured at different times after the brightness stabilization function is disabled and respectively comparing them, an adjustment of the image quality control set value, which performs image quality control in a state where the brightness stabilization function is active, becomes performed. Consequently, the accuracy of the display quality stabilization process when the brightness stabilization function is active, which is performed using an image quality control set value that is adjusted by measured optical values having respectively different displacement amounts compared to a state where the brightness stabilization function is active, becomes lower.

Therefore, in the configuration of the liquid crystal display device 300 using a configuration in which the optical sensor is provided on the display surface of the display panel, only a low-quality control of the display quality can be performed for users that require an accurate display image quality and a stable display quality.

PRIOR ART DOCUMENTS

Patent Document

[Patent Document 1]

[Patent Document 1] Japanese Unexamined Patent Application, First Publication No. 2008-102490

SUMMARY OF THE INVENTION

Problem to be Solved by the Invention

The problem to be solved is that, with respect to a liquid crystal display device with a configuration in which an optical sensor is provided on the display surface of the display panel, when the brightness stabilization function is disabled in order to perform an adjustment of the image quality control set value and to perform a measurement of a brightness value that corresponds to the gradient under various types of conditions, and a measurement such as a color measurement, a gamma characteristic measurement, or a measurement of the black brightness level or of a halftone brightness value is performed, the brightness value changes as a result of the time at which the measurement is performed, a measured optical value corresponding to the brightness value of the backlight in a state where the brightness stabilization function is operating cannot be obtained, and control of the display quality of the display image quality cannot be performed with a high accuracy.

Means for Solving the Problem

The display device of the present invention includes a display panel that displays an image; an optical sensor which is disposed facing a display surface of the display panel and measures an irradiation amount of light emitted by the display panel as a measured optical value; a measured value revising unit which revises a revision target measured optical value using a function and outputs it as a revised measured optical value, the revision target measured optical value being a measured optical value to be revised, the function representing an amount of change in the measured optical value per unit time; and a signal processing unit which generates from the revised measured optical value, a control value that controls the display panel to stabilize a display quality of the image displayed on the display panel, the signal processing unit generating a post-processing video signal displaying an image from the control value and an input video signal supplied from an external device, the function representing a change in the irradiation amount during a disabled period in which the signal processing unit disables a stabilizing function of keeping the irradiation amount of the light source of the display panel constant when measuring the revision target measured optical value.

The display device of the present invention may be such that the measured value revising unit includes: a timer unit that counts time; a coefficient calculation unit that calculates the function representing a relationship between a plurality of standard measured optical values and times at which the timer unit measures each of the standard measured optical values, the plurality of standard measured optical values being measured at different times including a start time at which the disabled period is started; and a revision calculation unit that, when the revised measured optical value is obtained from the revision target measured optical value, calculates from the function, an estimated standard measured optical value at time when the revision target measured optical values is measured, divides the standard measured optical value at the start time by the estimated standard measured optical value, sets a division result as a change ratio, multiplies the change ratio with the revision target measured optical value, and sets a multiplication result as the revised measured optical value.

The display device of the present invention may be such that the coefficient calculation unit obtains a difference between a first standard measured optical value and a second standard measured optical value and subtracts the difference by a time period to thereby calculate an amount of change in the measured optical value per unit time, the first standard measured optical value representing a measured optical value measured at a first time being the start time counted by the timer, the second standard measured optical value representing a measured optical value measured at a second time being later than the first time counted by the timer, the time period representing a difference between the first time and the second time, the coefficient calculation unit multiplies a time variable by the amount of change in the measured optical value and adds the first standard measured optical value to a multiplication result to thereby obtain a linear function, and the coefficient calculation unit sets the linear function as the function.

The display device of the present invention may be such that the coefficient calculation unit calculates a spline curve from the plurality of standard measured optical values measured at the different times, including the standard measured optical value measured at the start time, and sets the spline curve to the function.

The display device of the present invention may be such that a brightness value measured as the standard measured optical value is a white brightness level.

The display device of the present invention may be such that the revision target measured optical value represents a brightness value of each of a black brightness level, gamma characteristics, and a color measurement.

A display characteristic correction method of the present invention includes: a step of measuring, by an optical sensor disposed facing a display surface of a display panel of a liquid crystal display device, an irradiation amount of light emitted by the display panel as a measured optical value; a measured value revising step of, by a measure value revising unit, revising a revision target measured optical value using a function and outputting it as a revised measured optical value, the revision target measured optical value being a measured optical value to be revised, the function representing an amount of change in the measured optical value per unit time; and a signal processing step of, by a signal processing unit, generating from the revised measured optical value, a control value that controls the display panel to stabilize a display quality of the image displayed on the display panel, and generating a post-processing video signal that displays an image on the display panel from the control signal and an input video signal supplied from an external device, the function representing a change in the irradiation amount during a disabled period in which the signal processing unit disables a stabilizing function of keeping the irradiation amount of the light source of the display panel constant when measuring the revision target measured optical value.

Effect of the Invention

The display device of the present invention is such that, with respect to a liquid crystal display device with a configuration in which an optical sensor is provided on the display surface of the display panel, when the brightness stabilization function is disabled in order to adjust an image quality control set value and to measure a brightness value that corresponds to a gradient under all types of conditions, and measurements such as a color measurement, a gamma characteristic measurement, or a measurement of the black brightness level or a of halftone brightness value are performed, even if the brightness value changes as a result of the time at which the measurement is performed, a measured optical value corresponding to the brightness value of the backlight in a state where the brightness stabilization function is operating can be obtained, and control of the display quality of the display image quality can be performed with a high accuracy.

EMBODIMENTS FOR CARRYING OUT THE INVENTION

When an image quality control set value for maintaining a display quality of a display device is adjusted according to the surrounding environment and the change of a light source of the display device, the present invention disables a brightness stabilization function, and acquires a measured optical value used for the adjustment by means of an optical sensor provided opposing a display surface of a display panel. Then the present invention revises the measured optical value measured by the optical sensor by means of a function that is calculated according to a standard measured optical value that is measured at a different time, and uses it for the adjustment as a revised measured optical value.

Consequently, the present invention revises displacements resulting from changes in the brightness value irradiated by the light source of the display device, which changes over time due to disablement of the brightness stabilization function, with respect to a measured optical value that is measured when the brightness stabilization function is active.

Here, an image quality control set value for maintaining the display quality represents a set value group including, for example, respective gradient fractions of RGB when each color is displayed, a correspondence between maximum gradients of RGB and the maximum brightness value, or a control value that adjust the respective gamma curves used for revising the gamma characteristics, and the like.

Hereunder, a display device and a display characteristic correction method according to an exemplary embodiment of the present invention are described with reference to the drawings.

Figure 1:
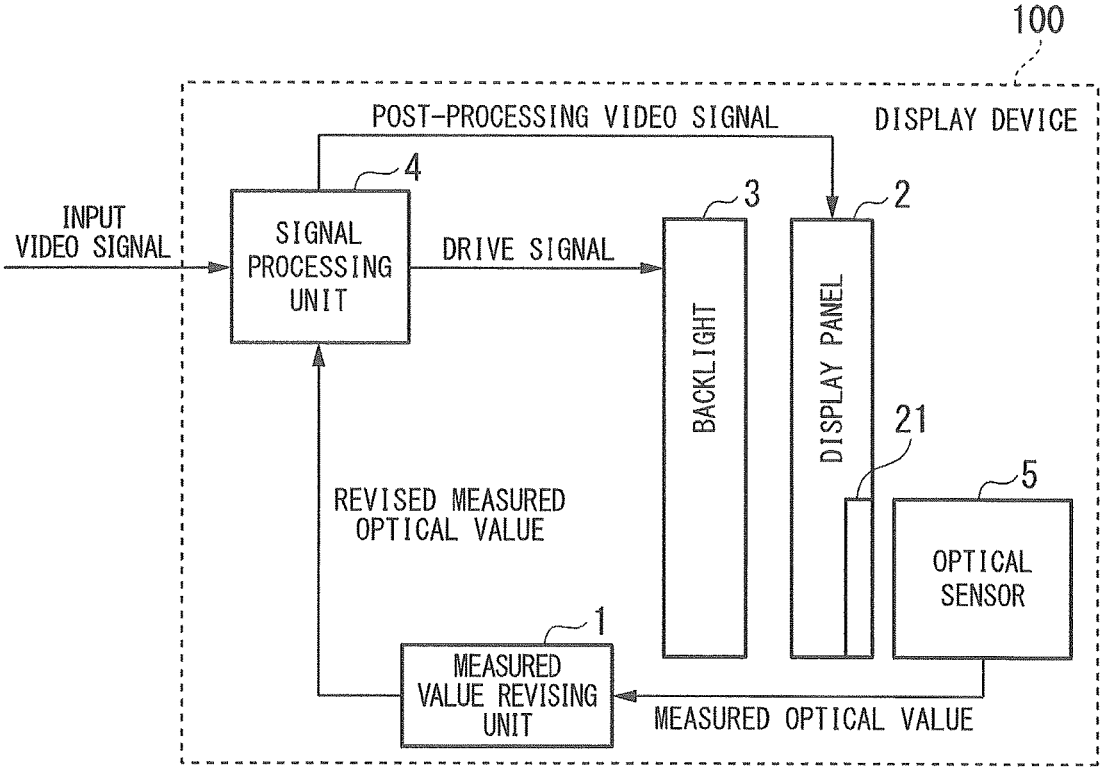
FIG. 1 is a block diagram showing a configuration example of a display device 100 according to an exemplary embodiment of a device of the present invention.

FIG. 1 is a block diagram showing a configuration example of a display device 100 according to an exemplary embodiment of the device of the present invention. In the present exemplary embodiment, as the display device 100, a liquid crystal display device having a display panel 2, which represents a liquid crystal panel in which a plurality of liquid crystal elements are arranged in a matrix form, is described as an example. However, it can be applied to any display device as long as it is made a configuration in which the brightness value irradiated by the light source of the display device changes over time in a case where the brightness stabilization function is disabled, or the display panel is configured by a device that changes its display characteristics over time.

Figure 7:
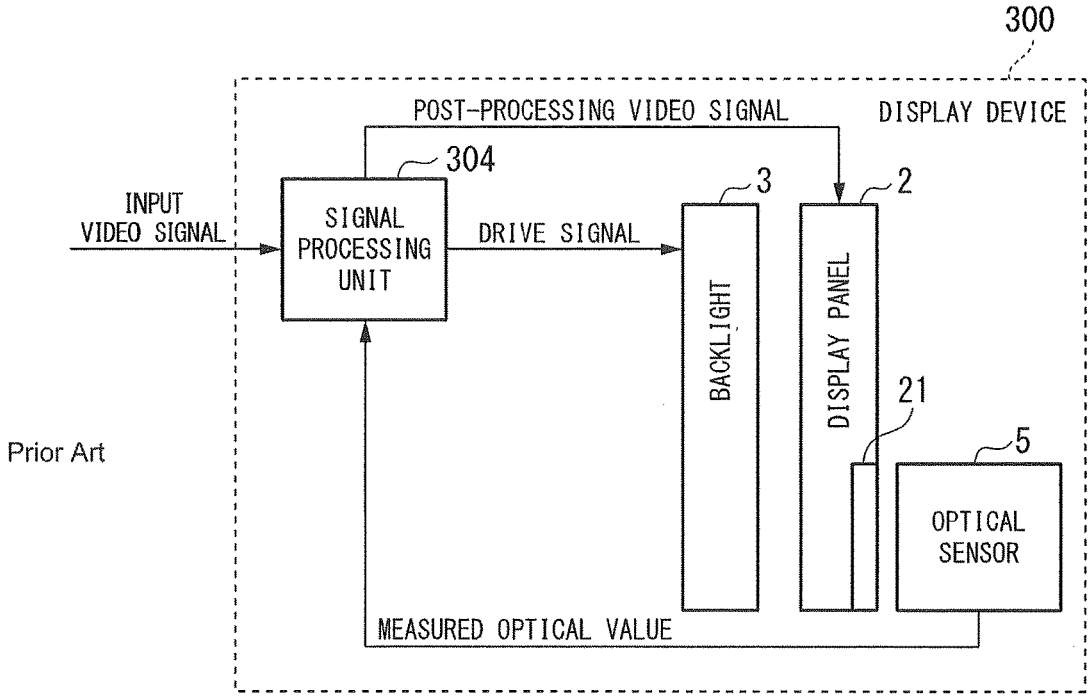
Prior Art FIG. 7
FIG. 7 is a diagram showing a configuration example of a liquid crystal display device of a configuration in which an optical sensor is provided on a display surface of a display panel.

In FIG. 1, the display device 100 includes a measured value revising unit 1, the display panel 2, a backlight 3, a signal processing unit 4, and an optical sensor 5. Here, the signal processing unit 4 performs the same operations as the signal processing unit 304 shown in FIG. 7. Hereunder the description of the signal processing unit 4 is such that only the portions that differ from the signal processing unit 304 are described.

The backlight 3 is provided facing the rear surface of the display panel 2, and irradiates light with respect to the rear surface of the display panel 2.

The optical sensor 5 measures the brightness value of the emitted light being the light which is irradiated to the rear surface of the display panel 2, passes through the display element of the display panel 2 and is emitted from the measurement area 21 of the display panel 2, and it outputs the measured brightness value to the measured value revising unit 1 as the measured optical value.

In a case where an adjustment start signal (mentioned below) that disables the brightness stabilization function is not supplied from the signal processing unit 4, that is to say, when the brightness stabilization function is active, the measured value revising unit 1 outputs the measured optical value from the optical sensor 5 as the revised measured optical value without revision. Furthermore, in a case where an adjustment start signal is supplied from the signal processing unit 4, that is to say, when the brightness stabilization function is disabled, the measured value revising unit 1 revises the measured optical value from the optical sensor 5 and outputs it as the revised measured optical value until a signal that indicates that the adjustment process has finished is supplied from the signal processing unit 4.

Figure 8:
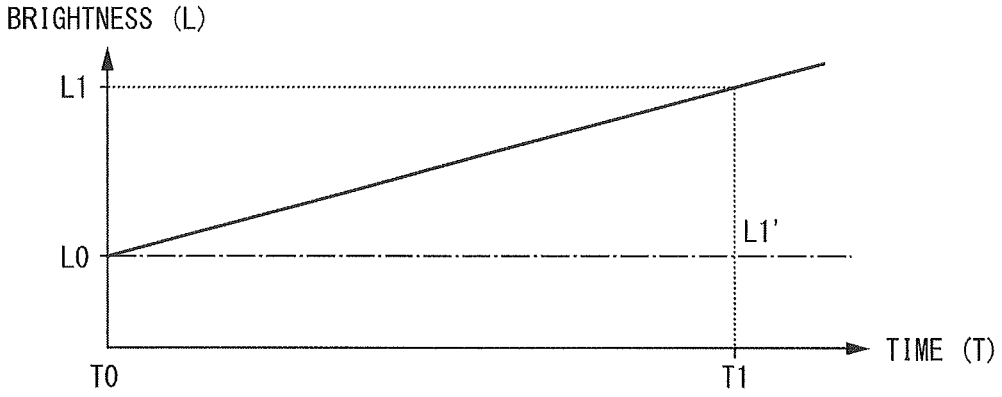
FIG. 8 is a diagram explaining a brightness value of light irradiated by a backlight 3.

The signal processing unit 4 outputs the adjustment start signal to the measured value revising unit 1 at the time it performs an adjustment of the image quality control set value, which is set in its interior. Furthermore, the signal processing unit 4 disables its own brightness stabilization function, and starts a brightness stabilization function disabled period. Consequently, the signal processing unit 4 stops the process that, in response to the brightness value supplied from the optical sensor 5, controls the brightness of the backlight 3 such that it is made constant as a preset brightness value. Consequently, in a case where the backlight 3 is a CCFL, the brightness value increases with time as shown in FIG. 8.

Then, after disabling the brightness stabilization function, the signal processing unit 4 outputs to the measured value revising unit 1, timing signals representing the timings at which the measured optical values used in the adjustment of the image quality control set value are to be acquired. Moreover, after outputting the timing signals at which all of the measured optical values necessary for the adjustment of the image quality control set value are to be acquired, the signal processing unit 4 transmits an adjustment termination signal to the measured value revising unit 1, and requests the transmission of the revised measured optical values necessary for the adjustment of the image quality control set value. Then, after the elapsing of a predetermined time that is preset in its interior, the signal processing unit 4 terminates the brightness stabilization function disabled period, and makes the brightness stabilization function active.

Here, when the signal processing unit 4 outputs the adjustment start signal, the adjustment termination signal, and the timing signals, it performs control of its own internal circuit such that, corresponding to the adjustment start signal, the adjustment termination signal, and the timing signals, it becomes the measured optical value state to be measured. For example, in a case where the standard measured optical value (mentioned below) used in the measured value revising unit 1 is set to the brightness value of the white brightness level, when the adjustment start signal and the adjustment termination signal mentioned below are transmitted, the liquid crystal elements in the measurement area 21 of the display panel 2 are controlled to the white brightness level. That is to say, the signal processing unit 4 supplies to the display panel 2 a video signal that controls the liquid crystal elements so as to give a degree of opening such that the brightness value of the light that is emitted via the liquid crystal elements of the measurement area 21 becomes the brightness value of the white brightness level.

For example, if the display panel 2 is a color liquid crystal panel, the signal processing unit 4 maximizes all of the RGB gradients with respect to the liquid crystal elements in the measurement area 21, which maximizes the degree of opening of the liquid crystal elements, making it the white brightness level.

Furthermore, for example, in a case where the brightness value of the black brightness level is set to be the measured optical value, when transmitting the timing signals, the signal processing unit 4 supplies a signal in which the gradient is of the minimum gradation with respect to all of the liquid crystal elements in the measurement area 21 of the display panel 2, which minimizes the degree of opening of the liquid crystal elements, making it the black brightness level.

Moreover, for example, in a case where the measurement of colors is performed by making the optical sensor 5 a color sensor having the three channels of RGB, it determines the combinations of the respective gradients of RGB preset by the user, and when transmitting a timing signal, it supplies a control signal containing the combination of gradients with the display panel 2. Then the signal processing unit 4, with respect to the measurement area 21 of the display panel 2, makes the measurement area 21 display the color according to the combination of gradients. Here, the signal processing unit 4 performs a process that observes whether or not the measured optical value of the respective channels of RGB obtained from the optical sensor 5 correspond to the measured value that is set corresponding to the gradients of the RGB combination that are preset, and adjusts the set value of the gradients for when the color is expressed.

Furthermore, for example, in a case where an adjustment of the gamma curve is performed, when the signal processing unit 4 converts the input video signal to a post-processing video signal that controls the liquid crystal elements of the display panel 2, it provides to the display panel 2 a control signal of the liquid crystal elements in which the gradients of the input video signal are successively and linearly amplified each time a timing signal is output to the measured value revising unit 1, without performing a revision by means of its internal gamma curve. Consequently, the signal processing unit 4 is able to extract the gamma characteristics of the display panel 2 based on the revised optical measured signals that show the changes in the brightness value resulting from changes in the gradient and are successively supplied from the optical sensor 5 via the measured value revising unit 1. As a result, the signal processing unit 4 performs an adjustment to the preset gamma curve so as to correspond to the gamma characteristics of the display panel 2 calculated from the measured optical values.

Moreover, in a case where an adjustment to the gamma curve is performed, it may be made a configuration in which the adjustment to the gamma curve is performed not on the input video signal supplied from an external device, but also with respect to an internal video signal, which represents a video signal generated and output by the signal processing unit 4, without performing a revision using the gamma curve mentioned above, and performing processing such that the signal is provided to the display panel 2, and performing processing such that the gamma characteristics are extracted.

As mentioned above, the signal processing unit 4 is such that, in the sequence in which the timing signals are output, it is set that which measurement of a measured optical value as the data for adjusting any of the set values of the image quality control set values, is to be performed. Therefore, the signal processing unit 4, by being sequentially supplied with revised measured optical values from the measured value revising unit 1 in this sequence, is able to perform discriminations in which they are which one of measured optical values as data for adjusting any of the control values in the set value group of image quality control set values.

Figure 2:
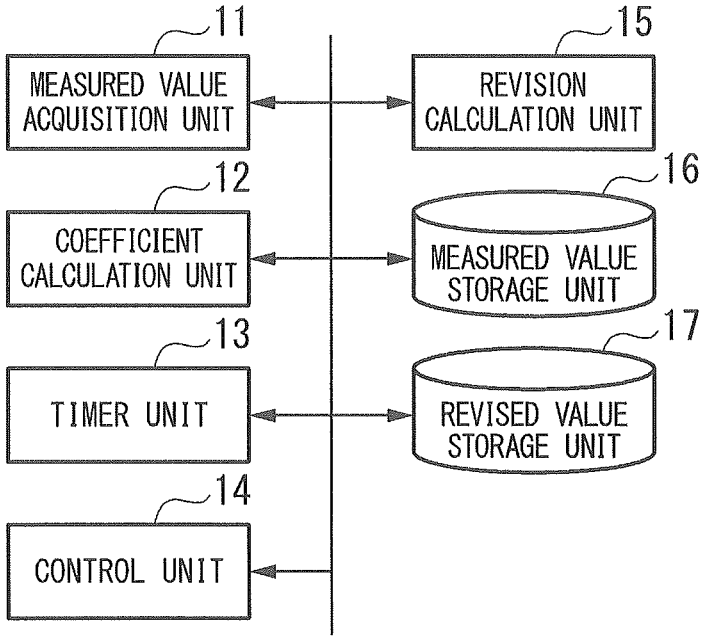
FIG. 2 is a block diagram showing a configuration example of a measured value revising unit 1 in FIG. 1.

Next, FIG. 2 is a block diagram showing a configuration example of the measured value revising unit 1 in FIG. 1. The measured value revising unit 1 according to the present exemplary embodiment includes a measured value acquisition unit 11, a coefficient calculation unit 12, a timer unit 13, a control unit 14, a revision calculation unit 15, a measured value storage unit 16, and a revised value storage unit 17.

The timer unit 13, at the point in time in which the adjustment start signal has been supplied from the signal processing unit 4, starts a time counting process after resetting the count value.

The measured value acquisition unit 11 set the measured optical value being output from the optical sensor 5 to the first standard measured optical value when the adjustment start signal is supplied from the signal processing unit 4, and the first standard measured optical value and the time T0 (for example, a counter value of zero with respect to the timer unit 13) representing the counter value of the timer unit 13 are written and stored as a group (that is to say, with a correspondence) to a standard value storage area in the measured value storage unit 16. It is necessary for the first standard measured optical value to represent a measured optical value in which the signal processing unit 4 has made the brightness stabilization function active, and that is controlled to the set brightness value.

Furthermore, the measured value acquisition unit 11 reads the measured optical value being output by the optical sensor 5 each time a timing signal at which the measured optical value is acquired is input.

At this time, the measured value acquisition unit 11, at the point in time in which it has read the measured optical value, reads the time Tn being output by the timer unit 13.

Then the measured value acquisition unit 11 writes and stores, as a group, identifying information (a number for example) that indicates the sequence in which the timing signal was input, and the measured optical value, together with the time Tn output by the timer unit 13 at the point in time the measured optical value was acquired, in a target measured optical value storage area of the measured value storage unit 16.

Moreover, the measured value acquisition unit 11 measures a measured optical value at the point in time the adjustment termination signal is supplied when an adjustment termination signal is supplied from the signal processing unit 4, and set the measured optical value to the second standard measured optical value. At this time, the measured value acquisition unit 11 reads the time Ts output by the timer unit 13 at the point in time in which the second standard measured optical value is acquired.

Then the measured value acquisition unit 11 writes the second standard measured optical value and the time Ts as a group with respect to the standard value storage region of the measured value storage unit 16, and outputs an acquisition completion signal, which indicates that the acquisition of the measured optical value has been completed, to the coefficient calculation unit 12.

The coefficient calculation unit 12 respectively reads out from the standard value storage area of the measured value storage unit 16, the first standard measured optical value L0 measured at the time T0, which represents the start time of the disabled period, and the second standard measured optical value L1 measured at the time T1, which represents the completion time of the disabled period, together with the respectively measured times T0 and T1.

Then the coefficient calculation unit 12 calculates a coefficient $\alpha$ by subtracting from the result of subtracting the first standard measured optical value L0 from the second standard measured optical value L1, the result of subtracting the time T0 at which the first standard measured optical value L0 is measured from the time T1 at which the second standard measured optical value L1 is measured.

Furthermore, the coefficient calculation unit 12 determines a function which shows the standard brightness value measured at a certain time and has, as a variable, the time interval that has elapsed from the time at which the brightness stabilization function was disabled in a case where the brightness stabilization function is disabled, that is to say, a linear function (first-order function) as shown in the formula (1) below. That is to say, the coefficient calculation unit 12 multiplies the coefficient $\alpha$ (the amount of change in the measured optical value) with respect to the time variable, and determines the formula (1) below as a linear function in which the first standard measured optical value L0 is added to the multiplication result.

$$L=L0+\alpha(Tn-T0) \quad (1)$$

In the formula (1)

$$\alpha=(L1-L0)/(T1-T0)$$

and Tn represents the time at which the measured optical value, which is the revision target, was measured.

Then the coefficient calculation unit 12 outputs the calculated function represented by the formula (1) to the revision calculation unit 15.

Figure 3:
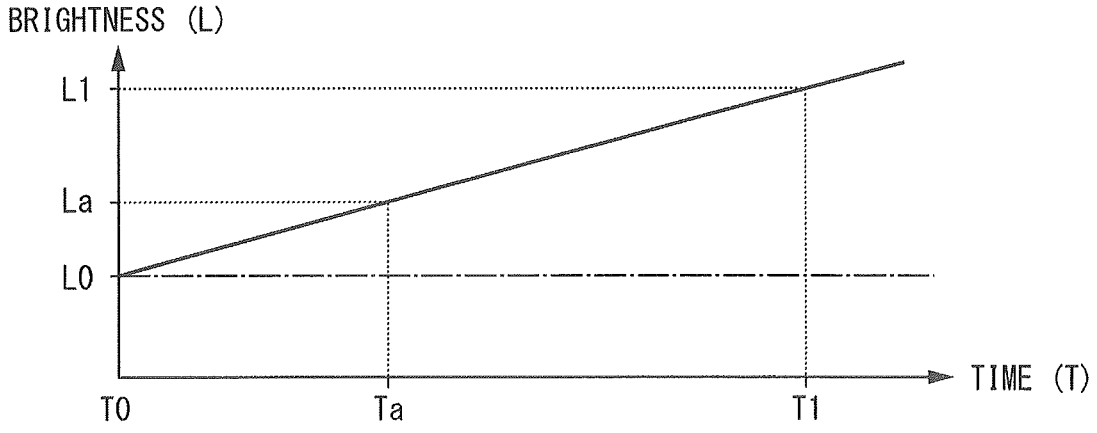
FIG. 3 is a graph showing a linear function generated by a coefficient calculation unit 12 in the present exemplary embodiment.

Next, FIG. 3 is a graph showing a linear function generated by the coefficient calculation unit 12 according to the present exemplary embodiment. In FIG. 3, the horizontal axis represents time and the vertical axis represents the brightness value L. It can be understood that the function of (1) is a linear function in which the brightness value L0 is the intercept of the vertical axis, and the slope is $\alpha$.

Returning to FIG. 2, when the function mentioned above is supplied from the coefficient calculation unit 12, the revision calculation unit 15 reads out and revises the revision target measured optical values stored in the target measured optical value storage area of the measured value storage unit 16 from the time nearest the time T0, that is to say, in a sequence from the smallest identifying information.

At this time, each time the revision calculation unit 15 reads out a revision target measured optical value, it substitutes the time Ta at which the revision target measured optical value was measured for Tn in formula (1), and, as shown in FIG. 3, calculates an estimated standard measured optical value La at the time Ta. Then the revision calculation unit 15 divides the first standard measured optical value L0 by the calculated estimated standard measured optical value La, and sets the division result to a change ratio $\beta$.

Then, the revision calculation unit 15 multiplies the measured optical value representing the revision target measured optical value by the calculated change ratio $\beta$, and calculates the multiplication result as the revised measured optical value of the measured optical value measured at time Ta. Here, by multiplying the measured optical value by the change ratio $\beta$, the measured optical value at time Tn becomes converted to a measured optical value that corresponds to the first standard brightness value L0 at the time T0, that is to say, at a point in time in which the brightness stabilization function is in effect.

Furthermore, the revision calculation unit 15 successively writes and stores the calculated revised measured optical values in connection with the identifying number (the number that indicates the sequence) of the corresponding measured optical value into the revised value storage unit 17.

Figure 4:
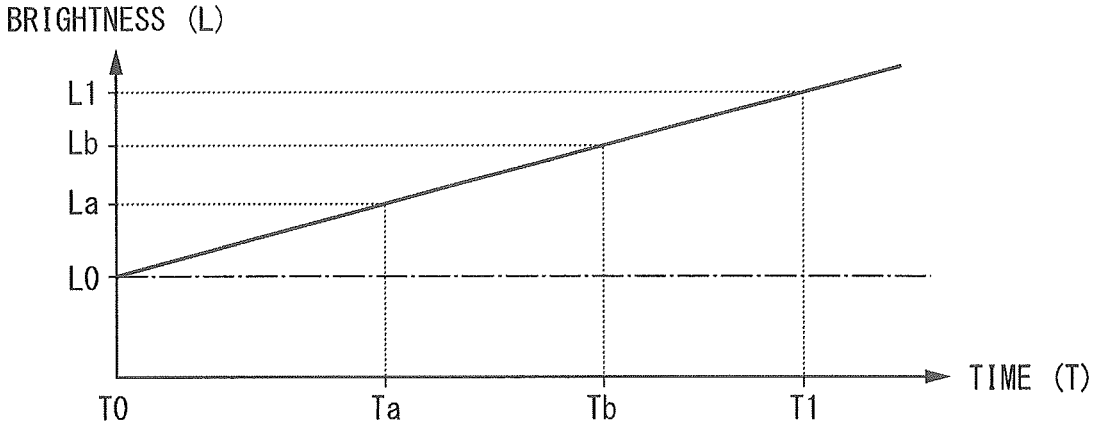
FIG. 4 is a graph explaining a process that calculates a successively estimated measured optical value from a linear function generated by the coefficient calculation unit 12 in the present exemplary embodiment.

Next, FIG. 4 is a graph explaining a process that calculates successively estimated measured optical values from the linear function generated by the coefficient calculation unit 12 in the present exemplary embodiment. In FIG. 4, the horizontal axis represents time and the vertical axis represents the brightness value L.

The revision calculation unit 15, as shown in FIG. 4, uses the formula (1) to sequentially calculate the estimated measured optical values at the times Ta and Tb, and calculates the change ratios $\beta a$ and $\beta b$ at the respective times. Then the revision calculation unit 15 respectively multiplies each of the change ratios $\beta a$ and $\beta b$ with the measured optical values measured at the times corresponding to the change ratios $\beta a$ and $\beta b$, and calculates revised measured optical values of the measured optical values at the respective times.

Then, when the revision calculation unit 15 calculates the revised measured optical values with respect to all of the target measured optical values that are stored in the target measured optical value storage area of the measured value storage unit 16, it outputs to the control unit 14 a process completion signal indicating that revision processing of the measured optical values has completed.

In a case where the control unit 14 is supplied with a process completion signal from the revision calculation unit 15, it transmits to the signal processing unit 4 a transmission-ready signal that indicates that revision processing of the acquired measured optical values has completed, and that the obtained revised measured optical values are transmittable.

When the signal processing unit 4 is supplied with a transmission-ready signal from the measured value revising unit 1, after changing to a mode that performs image quality adjustments for each of the image quality control set values, it transmits to the measured value revising unit 1 a transmission request signal indicating a request for the transmission of the revised measured optical values.

When the transmission request signal is supplied, the control unit 14 reads out for each identification number, the revised measured optical values stored in the revised value storage unit 17, for example by reading out in a numerical sequence in which they are stored (that is to say, in a numerical order that corresponds to the sequence of the timing signals at the time of the measurement), and together with a sequence number of the timing signal, successively outputs to the signal processing unit 4, the revised measured optical values that are read out.

Here, the signal processing unit 4 stores in an internal storage part of its own interior a correspondence table that associates the timing signal sequence number with a control value identification number indicating one of the control values in the set value group of image quality control set values.

Consequently, the signal processing unit 4, in association with the timing signal sequence number, writes and stores the revised measured optical values supplied from the measured value revising unit 1 with respect to the correspondence table.

Then when the signal processing unit 4 adjusts each of the control values in the set value group of image quality set values, it reads from the correspondence table the revised optical set value corresponding to the identification number of the control value, and performs adjustment processing of the corresponding control value.

For example, in a case where an adjustment of the gamma curve is performed, the signal processing unit 4, after stopping the gamma correction function and disabling gamma correction, outputs a brightness adjustment signal that is linearly increased with respect to a halftone gradient, to the display panel 2 each time a timing signal is output.

Then, the signal processing unit 4, by means of the sequence number of the revised measured optical value supplied from the measured value revising unit 1, determines which revised measured optical value is a measured value for performing a gamma characteristic measurement and is a measured value that corresponds to one of the gradation levels, and determines the gamma characteristics of the display panel 2 by comparing the set gradation level with the brightness value represented by the revised measured optical value. The signal processing unit 4, by means of the gamma characteristics determined by the revised measured optical value, calculates a gamma curve that revises the gamma characteristics, and makes it a control value among the new image quality control set values. Then the signal processing unit 4 makes active the gamma correction processing following completion of the adjustment processing of the gamma curve.

Furthermore, for example, in a case where adjustment of the black brightness level is performed, the signal processing unit 4 performs output to the display panel 2 with the gradient being at the lowest value when the timing signal is output.

Then, the signal processing unit 4, by means of the sequence number of the revised measured optical value supplied from the measured value revising unit 1, determines the revised measured optical value for adjusting the black brightness level from among the revised measured optical values supplied from the measured value revising unit 1, and determines the control value of the liquid crystal elements that become the preset brightness value by comparing the brightness value represented by the revised measured optical value with the brightness value of the preset black brightness level.

At this time, the signal processing unit 4 transmits a timing signal to the measured value revising unit 1 each time it modifies a control value, and calculates a control value that becomes a brightness value within a preset range. In the case of repetitive processing of a manner where, as with the control value of the brightness value of the black brightness level, an adjustment that determines the final control value is performed by measuring the brightness value according to an adjusted control value, and making a determination of whether or not the brightness value is contained in a preset brightness level range, the signal processing unit 4 may be configured such that it has an adjustment mode of only the repetitive processing.

As mentioned above, in the present exemplary embodiment, it is possible to revise a measured optical value after time has elapsed such that it is made to correspond to the brightness value of the white brightness level at the point in time where the brightness stabilization function is disabled (that is to say, at the point in time the brightness stabilization function is active), or in other words, such that it is made to correspond to the brightness value of the white brightness level in a state where the brightness is stable.

Consequently, according to the present exemplary embodiment, after disabling the brightness stabilization function, it is possible to eliminate the effect of the brightness value emitted by a light source that changes over time, and to adjust an image quality control set value in a state where the brightness stabilization function is operating, and it becomes possible to maintain the display quality.

Figure 5:
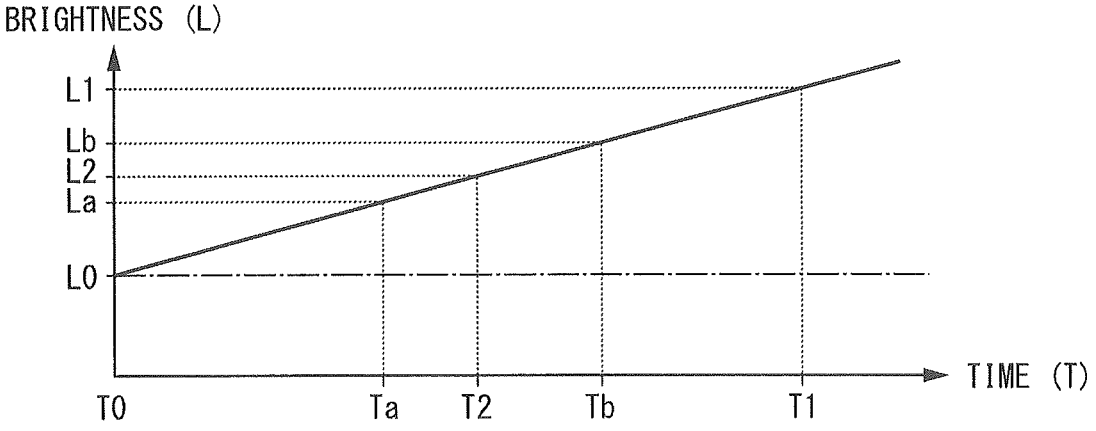
FIG. 5 is a graph explaining a process that calculates a revised measured optical value using three standard measured values, namely a first standard measured value, a second standard measured value, and a third standard measured value.
Figure 6:
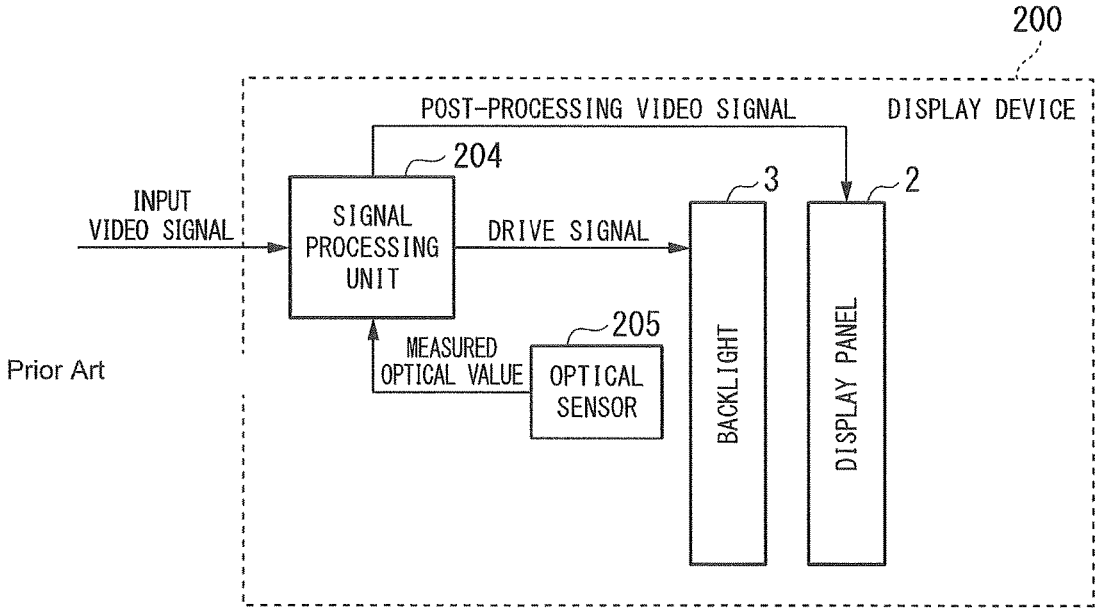
FIG. 6 is a diagram showing a configuration example of a liquid crystal display device of a configuration in which an optical sensor is provided on a rear surface of a display panel.

Furthermore, FIG. 5 is a graph explaining a process that calculates a revised measured optical value using three standard measured values, namely a first standard measured value (time T0), a second standard measured value (time T1), and a third standard measured value (time T2).

In the description of the exemplary embodiment mentioned above, the processing that revises a measured optical value into a revised optical value is performed according to the change quantity of the brightness value per unit time determined from the two standard measured values at the time T0 and the time T1.

However, if the time in which the brightness value stabilization function is disabled becomes long, then in the case of a two-point measurement, it is possible that the error in the revised measured optical value becomes large if a linear revision between these two points is performed.

Consequently, as shown in FIG. 5, the configuration may be such that, depending on the time period in which the brightness stabilization function is disabled, the brightness value of the white brightness level is measured with a plurality of three or more standard measured values, and the revision is performed using the plurality of standard measured values.

For example, as shown in FIG. 5, the first standard measured value L0 at the time T0, the second standard measured value L1 at the time T1, and the third standard measured value T2 at the time T2, are used.

Returning to FIG. 1, the coefficient calculation unit 12 determines the formula (2) below used in the revision of a measured optical value measured between the time T0 and the time T2, which represents linearity between the first standard measured value L0 and the third standard measured value.

$$L=L0+\alpha(Tn-T0) \tag{2}$$

In formula (2)

$$\alpha=(L2-L0)/(T2-T0)$$

and Tn represents the time at which the measured optical value, which is the revision target, was measured.

Then the revision calculation unit 15 determines a change ratio β from the formula (2), and calculates revised measured optical values for each of the measured optical values measured between the time T0 and the time T2.

That is to say, the revision calculation unit 15 substitutes into the formula (2), the time Ta for the time Tn, and calculates an estimated standard measured optical value La at the time Ta. Then, the revision calculation unit 15 calculates the revised measured optical value by dividing the first standard measured value L0 by the calculated estimated standard measured optical value La, and multiplying the measured optical value measured at the time Ta by the coefficient β.

Furthermore, the coefficient calculation unit 12 determines the formula (3) below used in the revision of a measured optical value measured between the time T2 and the time T1, which represents linearity between the first standard measured value L0 and the third standard measured value.

$$L=L2+\alpha(Tn-T2) \tag{3}$$

In formula (3)

$$\alpha=(L1-L2)/(T1-T2)$$

and Tn represents the time at which the measured optical value, which is the revision target, was measured.

Then the revision calculation unit 15 determines a change ratio β from the formula (2), and calculates revised measured optical values for each of the measured optical values measured between the time T2 and the time T1.

That is to say, the revision calculation unit 15 substitutes into the formula (3), the time Tb for the time Tn, and calculates an estimated standard measured optical value Lb at the time Tb. Then, the revision calculation unit 15 calculates the revised measured optical value by dividing the third standard measured value L2 by the calculated estimated standard measured optical value Lb, and multiplying the measured optical value measured at the time Tb by the coefficient β.

As mentioned above, during the time period in which the brightness stabilization function is disabled, a plurality of standard measured values is measured, and linear functions are determined at each time period at which adjacent standard measured values were measured. Then corresponding to each of the linear functions, by revising the measured optical values at the respective periods between the standard measured values, it is possible to obtain revised measured optical values with a higher accuracy.

Furthermore, in the manner of FIG. 5, in a case where a plurality of three or more standard measured values are measured, the configuration may be such that linear functions between the standard measured values are not calculated, but spline curves corresponding to changes in the actual brightness value of the white brightness level are generated from the standard measured values. Then by performing spline corrections by means of the change ratios determined from the generated spline curves, it is possible to perform revisions in which the measured optical values are made revised measured optical values with a higher accuracy.

Moreover, the signal processing unit 4 may be configured such that, at the time T2 in FIG. 5, that is to say, between measurements of the measured optical values, it temporarily stops measurement processing of the measured optical values, and after the brightness stabilization function is made active and the brightness value of the white brightness level is stabilized, it disables the brightness stabilization function again, and restarts measurement processing of the measured optical values. Consequently, in cases such as where the measured quantity of measured optical values is large and the time interval in which the brightness stabilization function is disabled becomes long, it is possible to substantially reduce the time interval in which the brightness stabilization function is disabled. Therefore, it becomes possible to reduce the amount of change in the brightness value, and the error when a measured optical value is revised into a revised measured optical value can be made smaller.

Furthermore, the standard measured value used in the revision has been described using the brightness value of the white brightness level. However, instead of the brightness value of the white brightness level, any brightness value, such as the brightness value of any color, or the brightness value of the black brightness level, can be used so long it is able to act as a standard.

Moreover, although a liquid crystal display device has been described as an example in the exemplary embodiment, it can also be applied to any type of display device as long as it is a device in which a measured optical value, such as a brightness value, changes over time.

The processing that disables the brightness stabilization function and measures a measured optical value in order to adjust an image quality control set value may also be made any among a configuration in which a user inputs an instruction that adjusts the image quality control set value with respect to the display device 100 from an input device (not shown in the figure), or a configuration in which the signal processing unit 4 is started each time a preset time elapses after power is input into the display device 100, or a configuration provided with both of these.

INDUSTRIAL APPLICABILITY

In industrial fields where it is used in applications that require high-accuracy color reproduction, for example by using it as a display device (for example, a liquid crystal display device) for computer graphics or for medical applications, it is possible to realize the maintenance of stability in the display quality of a display image with respect to a user over an extended period.

REFERENCE SYMBOLS

1 Measured value revising unit
2 Display panel
3 Backlight
4 Signal processing unit
5 Optical sensor
11 Measured value acquisition unit
12 Coefficient calculation unit
13 Timer unit
14 Control unit
15 Revision calculation unit
16 Measured value storage unit
17 Revised value storage unit
21 Measurement area
100 Display device

The invention claimed is:

1. A display characteristic correction method, comprising:

measuring, by an optical sensor disposed facing a display surface of a display panel of a liquid crystal display device, an irradiation amount of light emitted by the display panel as a measured optical value;

revising, by a non-transitory measure value processor, a revision target measured optical value using a function and outputting it as a revised measured optical value, the revision target measured optical value being a measured optical value to be revised;

generating, by a signal processor, from the revised measured optical value, a control value that controls the display panel to stabilize a display quality of the image displayed on the display panel, and generating a post-processing video signal that displays an image on the display panel from the control signal and an input video signal supplied from an external device, the function representing a relationship between the irradiation amount and time during a disabled period in which the signal processor disables a stabilizing function of keeping the irradiation amount of the light source of the display panel constant when measuring the revision target measured optical value;

counting, by a timer, time; and calculating, by a coefficient calculator, the function based on a plurality of standard measured optical values and times which are measured by the timer and represent times at which the standard measured optical values are measured, the plurality of standard measured optical values being measured at different times including a start time at which the disabled period is started.

2. A display device, comprising:

a display panel that displays an image;

an optical sensor which is disposed facing a display surface of the display panel and measures an irradiation amount of light emitted by the display panel as a measured optical value;

a non-transitory measured value processor which revises a revision target measured optical value using a function and outputs it as a revised measured optical value, the revision target measured optical value being a measured optical value to be revised; and a signal processor which generates from the revised measured optical value, a control value that controls the display panel to stabilize a display quality of the image displayed on the display panel, the signal processor generating a post-processing video signal displaying an image from the control value and an input video signal supplied from an external device, the function representing a relationship between the irradiation amount and time during a disabled period in which the signal processor disables a stabilizing function of keeping the irradiation amount of the light source of the display panel constant when measuring the revision target measured optical value, wherein the non-transitory measured value processor includes:

a timer that counts time;

a coefficient calculator that calculates the function based on a plurality of standard measured optical values and times which are measured by the timer and represent times at which the standard measured optical values are measured, the plurality of standard measured optical values being measured at different times including a start time at which the disabled period is started.

3. The display device according to claim 2, wherein the coefficient calculator obtains a difference between a first standard measured optical value and a second standard measured optical value and divides the difference by a time period to thereby calculate an amount of change in the measured optical value per unit time, the first standard measured optical value representing a measured optical value measured at a first time being the start time counted by the timer, the second standard measured optical value representing a measured optical value measured at a second time being later than the first time counted by the timer, the time period representing a difference between the first time and the second time, the coefficient calculator multiplies a time variable by the amount of change in the measured optical value and adds the first standard measured optical value to a multiplication result to thereby obtain a linear function, and the coefficient calculator sets the linear function as the function.

4. The display device according to claim 2, wherein the coefficient calculator calculates a spline curve from the plurality of standard measured optical values measured at the different times, including the standard measured optical value measured at the start time, and sets the spline curve to the function.

5. The display device according to claim 2, wherein a brightness value measured as the standard measured optical value comprises a white brightness level.

6. The display device according to claim 2, wherein the revision target measured optical value represents a brightness value of each of a black brightness level, gamma characteristics, and a color measurement.

7. The display device according to claim 2, wherein the non-transitory measured value processor further includes:

a revision calculator that calculates from the function, an estimated standard measured optical value, divides the standard measured optical value at the start time by the estimated standard measured optical value, sets a division result as a change ratio, multiplies the change ratio with the revision target measured optical value, and sets a multiplication result as the revised measured optical value.

* * * * *